US007536971B1

(12) United States Patent
Fry

(10) Patent No.: US 7,536,971 B1
(45) Date of Patent: May 26, 2009

(54) LOWERABLE WATER SPORT TOW ATTACHMENT

(76) Inventor: John Fry, 40041 Via Espana, Murrieta, CA (US) 92562

( * ) Notice: Subject to any disclaimer, the term of this patent is extended or adjusted under 35 U.S.C. 154(b) by 0 days.

(21) Appl. No.: 12/034,563

(22) Filed: Feb. 20, 2008

(51) Int. Cl.
*B63B 17/00* (2006.01)

(52) U.S. Cl. ..... 114/361

(58) Field of Classification Search ..... 114/361, 114/343, 364, 285; 74/499, 127, 89.23
See application file for complete search history.

(56) References Cited

U.S. PATENT DOCUMENTS

| | | | | |
|---|---|---|---|---|
| 3,326,175 | A | 6/1967 | Baker | |
| 3,797,444 | A | 3/1974 | Stubbs | |
| 3,886,888 | A | 6/1975 | Parsons | |
| 3,919,963 | A | 11/1975 | Cox, III | |
| 4,480,577 | A | 11/1984 | Naypaver | |
| 5,809,831 | A * | 9/1998 | Nagai et al. | 74/89.4 |
| 6,119,617 | A | 9/2000 | Oswell | |
| 6,178,837 | B1 * | 1/2001 | Nagai et al. | 74/89.23 |
| 6,192,819 | B1 | 2/2001 | Larson et al. | |
| 6,209,477 | B1 * | 4/2001 | Biedenweg | 114/361 |
| 6,374,762 | B1 | 4/2002 | Larson et al. | |
| RE37,823 | E | 9/2002 | Larson et al. | |
| 6,474,588 | B2 | 11/2002 | Valverde | |
| 6,666,159 | B2 | 12/2003 | Larson et al. | |
| 6,672,238 | B2 | 1/2004 | Sheikholeslam et al. | |
| 7,013,822 | B2 | 3/2006 | Gencarelli | |
| 7,197,998 | B1 | 4/2007 | Rice | |
| 7,234,408 | B1 | 6/2007 | Clemmons et al. | |

* cited by examiner

*Primary Examiner*—Ed Swinehart
(74) *Attorney, Agent, or Firm*—Kenneth L. Green; Edgar W. Averill, Jr.

(57) ABSTRACT

A water craft includes a tow tower including a tower loop raised and lowered by two linear actuators. The tower loop is firmly supported in the raised position by the linear actuators to provide a proper attachment for towing enthusiasts, and is lowered to allow the water craft to be stored in a normal height garage structure. The linear actuators are unique designs with large shaft diameter, short stroke, and high overlap between the shaft and actuator body, and in particular include novel compressible bumpers to create a compressive jam-lock counterforce at full extension to effectively jam-lock the linear actuator and prevent back creep.

11 Claims, 5 Drawing Sheets

20
5
5

20
46
40
36
36'
44
42
D
34
30
30a
32
48

20
46
36
38
40
34
30
44
42
30a
32
48

40
46
45
44
42
36
30b
38
31
34
30
30a
32
48

LOWERABLE WATER SPORT TOW ATTACHMENT

BACKGROUND OF THE INVENTION

The present invention relates to water sport towing attachments and in particular to a water sport towing attachment which may be lowered automatically using linear actuators.

Water sports often involve towing a water sports enthusiast behind a water craft. In some instances, a preferred tow point is high and near the center of the water craft. Unfortunately, a permanent structure of sufficient height will generally interfere with storing the water craft in a residential garage. Known towers extend vertically to between approximately five feet and ten feet above the floor of the water crafts. Folding towers are known which allow the towers to be folded manually, but are difficult to handle. For example, U.S. Pat. No. 6,666,159 for "Water Sport Towing Apparatus," discloses a tow tower which may be manually pivoted forward against a forward deck of the water craft to provide a lower profile for passing under bridges or into a boat house. While this addresses the height issue, it is often difficult to manually lower the tower of the '159 patent. The '159 patent is herein incorporated by reference in its entirety.

Although not directed to lowering a towing tower, U.S. Pat. No. 7,234,408 for "Water Sport Tow Attachment With Recoil," discloses a tower supported by pneumatic or hydraulic cylinders. The '408 patent uses the cylinders to provide a recoil action in the tower to allow enthusiasts to use stored compressive energy in the cylinders to achieve better jumps and the like. Although the '408 patent does not disclose also using the cylinders to lower the tower for storing the boat in a garage, such lowering might be achieved without significant modifications. However, a tower supported by pneumatic or hydraulic cylinders presents an unacceptable risk of injury if a pneumatic or hydraulic leak or line breakage occurs. Because of the location of the tower, it is likely that the tower would slam down on occupants of the boat.

BRIEF SUMMARY OF THE INVENTION

The present invention addresses the above and other needs by providing a water craft which includes a tow tower raised and lowered by two linear actuators. The tow tower is firmly supported in the raised position by the linear actuators to provide a proper attachment for towing enthusiasts, and is lowered to allow the water craft to be stored in a normal height garage structure. The linear actuators are unique designs with large shaft diameter, short stroke, and high overlap between the shaft and actuator body, and in particular include novel compressible bumpers to create a compressive counterforce at full extension to effectively jam-lock the linear actuator and prevent back creep.

In accordance with one aspect of the invention, there is provided a water craft and tow tower. The water craft has a bow, a mid section, and a stern. The tow tower includes a tower support structure firmly attached to the water craft and residing near the mid section of the water craft and a tower loop pivotally attached to the tower support structure by tower pivots and forming a "U" shaped loop, an open end of the "U" to the bow of the water craft. Two lockable linear actuators pivotally attached between the tower support structure and the tower loop, the linear actuators having a retracted position, wherein the tower loop is lowered and in an extended position wherein the tower loop is raised, and wherein the linear actuators jam-lock in the fully extended position until the linear actuators are reversed.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1A:
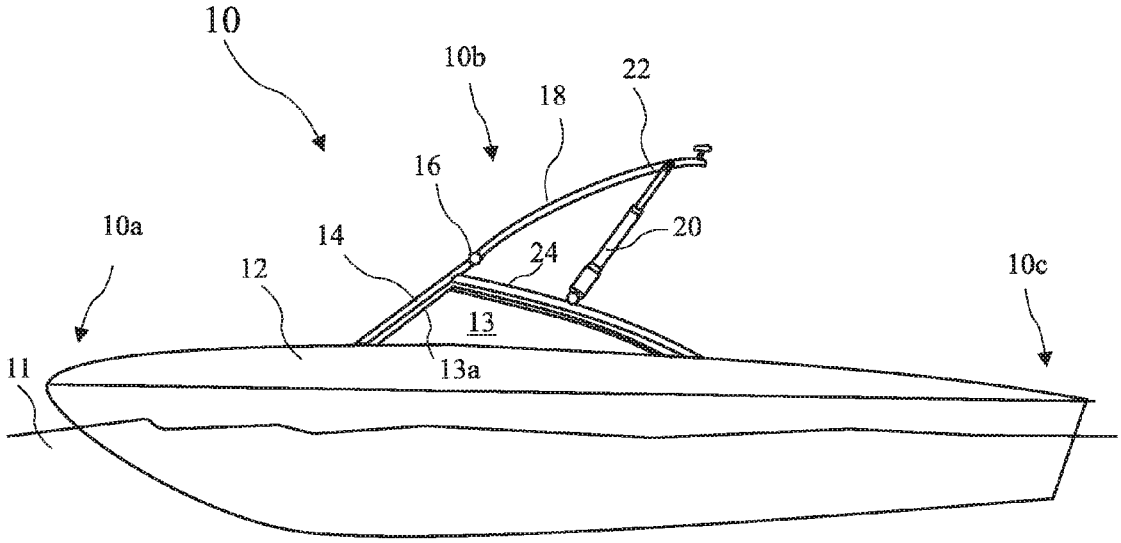
FIG. 1A is a side view of a water craft with a tower loop of a tow tower according to the present invention in a raised position.
Figure 1B:
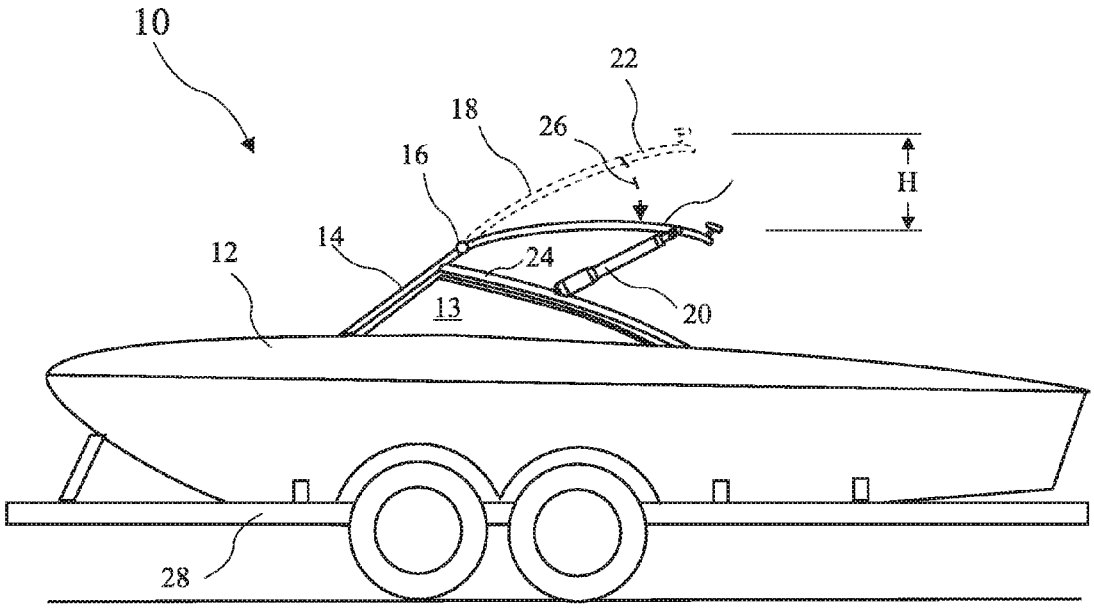
FIG. 1B is a side view of the water craft on a trailer with the tower loop of the tow tower according to the present invention in a lowered position.

A side view of a water craft 10 with a tower loop 18 of a tow tower 11 according to the present invention is shown in a raised position in FIG. 1A and a side view of the water craft 10 on a trailer 28 with the tower loop 18 of the tow tower 11 according to the present invention in a lowered position is shown in FIG. 1B. The water craft 10 includes a bow 10*a*, and mid section 10*b*, a stern 10*c*, a deck 12, and a seating area 15. The tow tower 11 comprises the tower loop 18 and a tower support structure 14 supporting the tower loop 18. The tower loop 18 is connected to the tower support structure 14 by tower pivots 16 and raised and lowered by linear actuators 20 pivotally connected between the tower support structure 14 and the tower loop 18. The tower support structure 14 preferably outlines a windshield 13 of the water craft 10 to provide an aesthetic appearance (also see a top view in FIG. 2).

The linear actuators 20 are electrically operated preferably using 12 volt Direct Current (DC) power and are preferably controlled using a momentary Double Pole Double Throw (DPDT) switch whereby a user watches the tower loop 18 raise or lower, and releases the DPDT switch when the tower loop 18 is fully raised or fully lowered. The overall height to the water craft 10 and tow tower 11 is reduced by a height H when the linear actuators 20 are fully retracted. The height H is preferably between approximately three feet and approximately five feet and the linear actuators 20 are connected between the tower support structure 14 and the tower loop 18 so that approximately ten inches of linear actuators 20 raises and lowers the tower loop 18.

Figure 2:
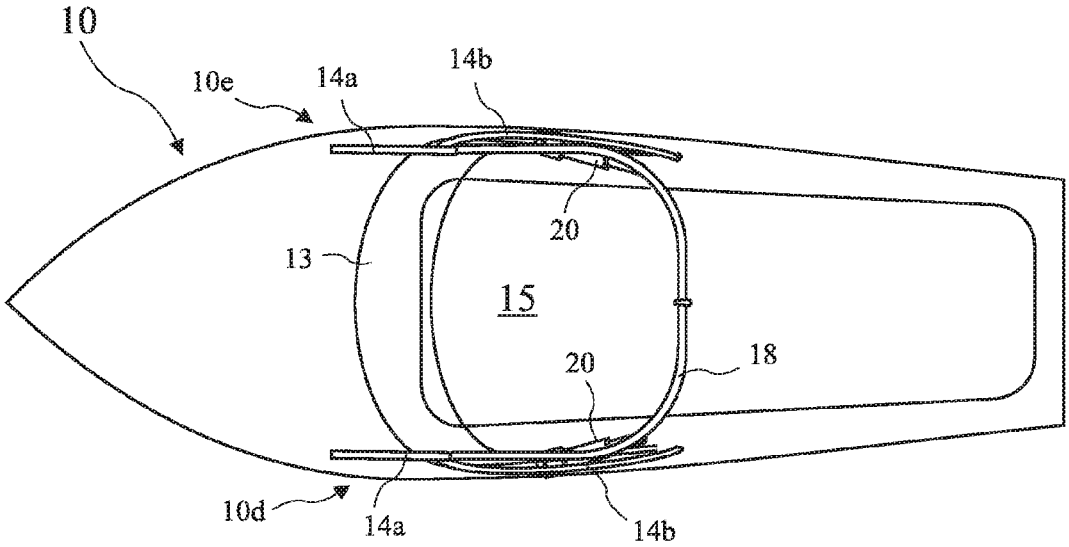
FIG. 2 is a top view of the water craft and tow tower.

A top view of the water craft 10 and tow tower 11 is shown in FIG. 2. The water craft 10 has a port (or left) side 10*d* and a starboard (or right) side 10*e*. The tower support structure 14 includes forward braces 14*a* extending upwards and rearward from the deck 12 approximately leading the leading edge 13*a* (see FIG. 1A) of the windshield 13, and rear braces 14*b* connected to the forward braces and extending rearward and downward to the deck 12 thus forming a four point support structure firmly attached to the water craft 10. In some instance, backing plates may be used to strengthen the attachment of the tower support structure 14 to the deck 13.

The linear actuators 20 reside at about a 45 degree angle above the horizontal and tilted back when the tower loop 18 is raised, and recline to about a five degree to ten degree angle above the horizontal when the tower loop is lowered.

Figure 3A:
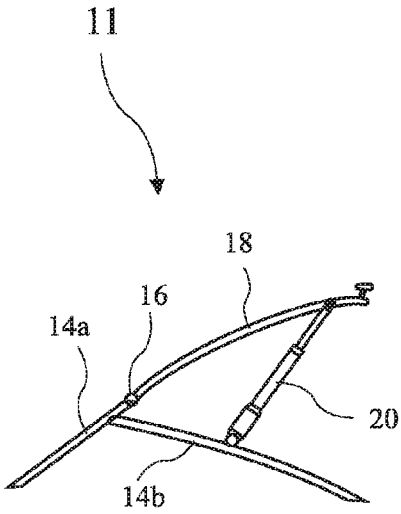
FIG. 3A is side view of the tow tower only.
Figure 3B:
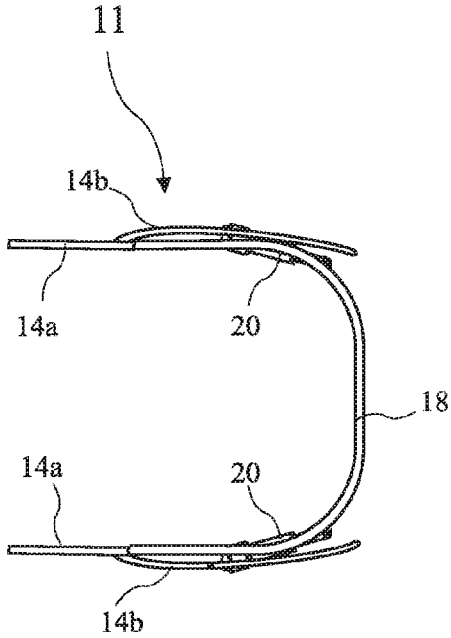
FIG. 3B is a top view of the tow tower only.

For further clarification, a side view of the tow tower 11 only is shown in FIG. 3A and a top view of the tow tower 11 only is shown in FIG. 3B.

A prototype of the tow tower 11 was constructed using known linear actuators. Unfortunately, such known linear actuators were not suitable because they either flexed at full extension, or gradually backed off when subjected to jarring loads experienced by the tower pool 18. The linear actuator 20 of the present invention was developed to overcome these issues.

Figures 4, 5A, 5B, 6, 7:
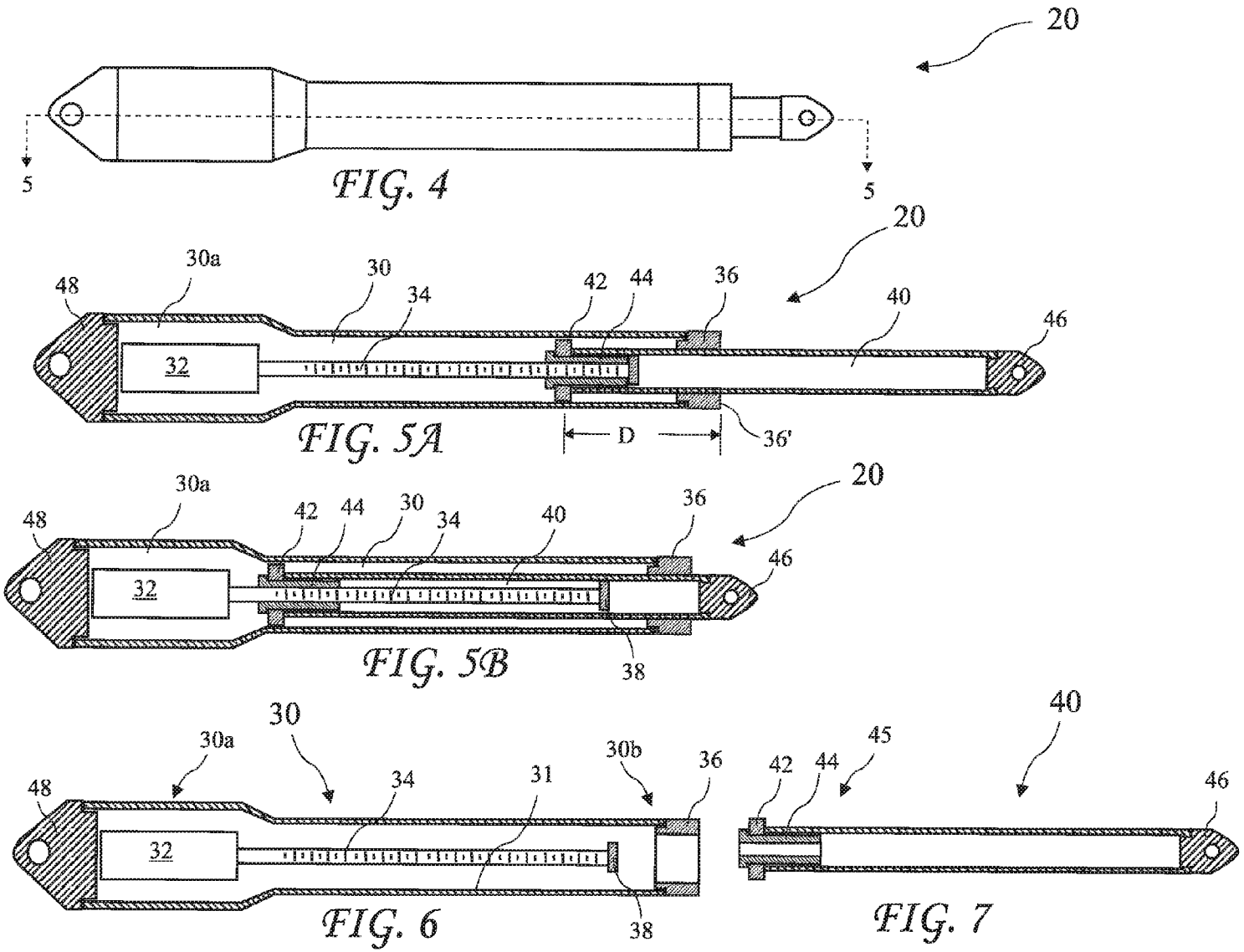
FIG. 4 is a side view of a linear actuator according to the present invention for raising and lowering the tower loop.
FIG. 5A is a cross-sectional view of the linear actuator taken along line 5-5 of FIG. 4 with an actuator piston in an extended position.
FIG. 5B is a cross-sectional view of the linear actuator taken along line 5-5 of FIG. 4 with the actuator piston in a retracted position.
FIG. 6 is a cross-sectional view of an actuator body according to the present invention taken along line 5-5 of FIG. 4 of the linear actuator.
FIG. 7 is a cross-sectional view of the actuator piston taken along line 5-5 of FIG. 4.

A side view of the linear actuator 20 according to the present invention for raising and lowering the tower loop 18 is shown in FIG. 4. A cross-sectional view of the linear actuator 20 taken along line 5-5 of FIG. 4 with an actuator piston 40 in an extended position is shown in FIG. 5A and a cross-sectional view of the linear actuator 20 taken along line 5-5 of FIG. 4 with the actuator piston in a retracted position is shown in FIG. 5B. A cross-sectional view of the actuator body 30 of the linear actuator 20 taken along line 5-5 of FIG. 4 is shown in FIG. 6 and a cross-sectional view of the actuator piston 40 taken along line 5-5 of FIG. 4 is shown in FIG. 7. For safe operation, the tow tower 11 must be elevated by apparatus which securely holds the tower loop 18 and does not include a failure mode wherein the tower loop 18 may drop rapidly into the seating area 15. Therefore, hydraulic or pneumatic apparatus for raising the tower loop 18 is not acceptable because a line failure may allow rapid and unexpected lowering of the tower loop 18. Further, although an electro mechanical apparatus such as a common linear actuator is not likely to allow the tower loop 18 to fall rapidly, the jarring forces exerted on the tower loop 18 while towing an enthusiast tends to result in a gradual lowering the tower loop 18, which is not acceptable by the enthusiast.

The linear actuators 20 according to the present invention include an actuator body 30 and an electric actuator motor 32 residing in a base 30*a* of the actuator body 30. A rotating externally threaded actuator screw 34 resides in the actuator body 30 and is mechanically connected to the actuator motor 32, which actuator motor 32 turns the actuator screw 34. An actuator piston 40 extends from the actuator body 30 and is extendable and retractable from the actuator body 30. An actuator piston nut 44 is fixed to an inside end 45 of the actuator piston 40 and includes internal threads which threadably engage external threads on the actuator screw for extending and retracting the actuator piston 40. An actuator piston bushing 42 is fixed to the inside end of the actuator piston 40 to slide on an inside wall 31 of the actuator body 30 and an actuator body bushing 36 is fixed to an actuator body mouth 30*b* opposite the base 30*a*, which actuator body bushing 36 includes an inside surface allowing sliding of the actuator piston 40. An actuator body end cap 48 resides at the base 30*a* of the actuator body and includes a mouth for pivotally attaching to the tower support structure 14. An actuator piston end cap 46 is attached to the actuator piston 40 opposite the inside end 45 of the actuator piston 40 for pivotally connecting to the tower loop 18.

To address the known issues, the linear actuators 20 according to the present invention include a novel jam-locking feature which prevents a gradual lowering of the tower loop 18 during use. Specifically, the linear actuators 20 include a screw cap 38 which is jammed against the actuator piston nut 44 at full extension of the actuator piston 40, where at least one of the screw cap 38 and the actuator piston nut 44 having a compressible portion compressed between the screw cap 38 and the actuator piston nut 44 at full extension of the linear actuators 20, to provide sufficient residual force on the engagement of threads on an actuator screw 34 with the actuator piston nut 44 to prevent the actuator screw 34 from gradually turning and lowering the tower loop 18. Preferably, the screw cap 38 is made from plastic or is metal with plastic on a surface which contacts the actuator screw nut 44 at full extension of the actuator piston.

An overlap distance D between the actuator piston bushing 42 and a forward edge 36' of the actuator body bushing 36 is provided for strength. The distance D is preferably at least five inches and more preferably approximately seven inches.

Figure 8A:
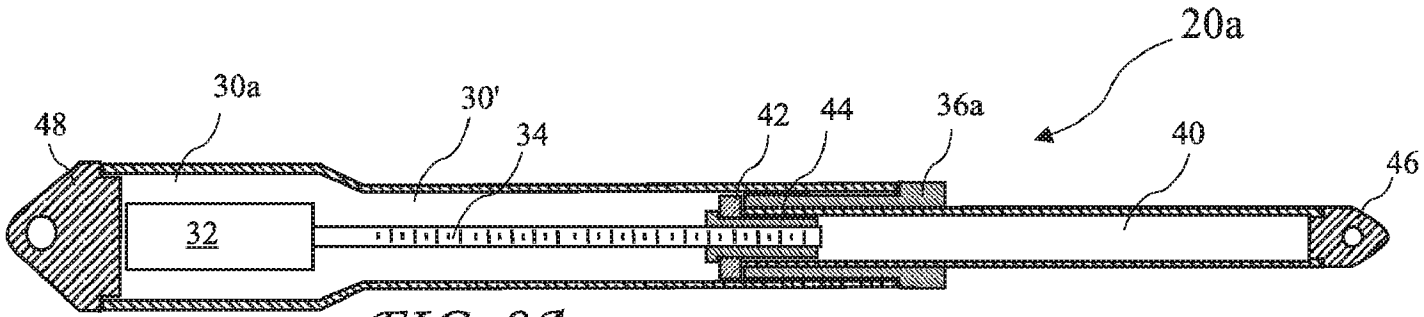
FIG. 8A is a cross-sectional view of a second embodiment of the linear actuator taken along line 5-5 of FIG. 4 with an actuator piston in an extended position.
Figure 8B:
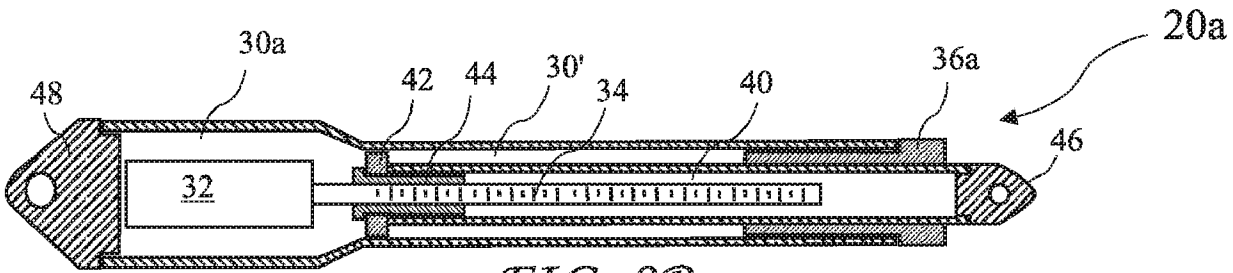
FIG. 8B is a cross-sectional view of the second linear actuator taken along line 5-5 of FIG. 4 with the actuator piston in a retracted position.
Figure 9:
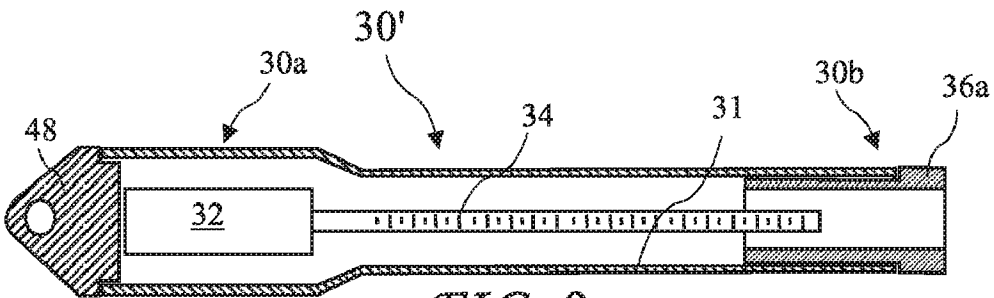
FIG. 9 is a cross-sectional view of a second embodiment actuator body of the second linear actuator according to the present invention taken along line 5-5 of FIG. 4 of the second linear actuator.

A cross-sectional view of a second embodiment of the linear actuator 20*a* taken along line 5-5 of FIG. 4 with the actuator piston 40 in an extended position is shown in FIG. 8A, a cross-sectional view of the second linear actuator 20*a* taken along line 5-5 of FIG. 4 with the actuator piston 40 in a retracted position is shown in FIG. 8B, and a cross-sectional view of a second embodiment actuator body 30' of the second linear actuator 20*a* according to the present invention taken along line 5-5 of FIG. 4 of the second linear actuator is shown in FIG. 9. The first linear actuator 20 works well in most instances, but in some instances, the screw cap 38 may wear and result in changes of the friction between the screw cap 38 and the actuator piston nut 44. In these instances, the release from a fully raised position may not be even, and the tower loop 18 may be twisted. To avoid wear, the second actuator 20*b* replaces the screw cap 38 with an extended actuator body bushing 36*a*. At full extension, the extended actuator body bushing 36*a* contacts the actuator piston bushing 42 and some compression results, creating the residual force on the engagement of threads on an actuator screw 34 with the actuator piston nut 44. Because the extended actuator body bushing 36*a* does not turn, it does not wear and cause changes to tower loop 18 lowering.

Figure 11:
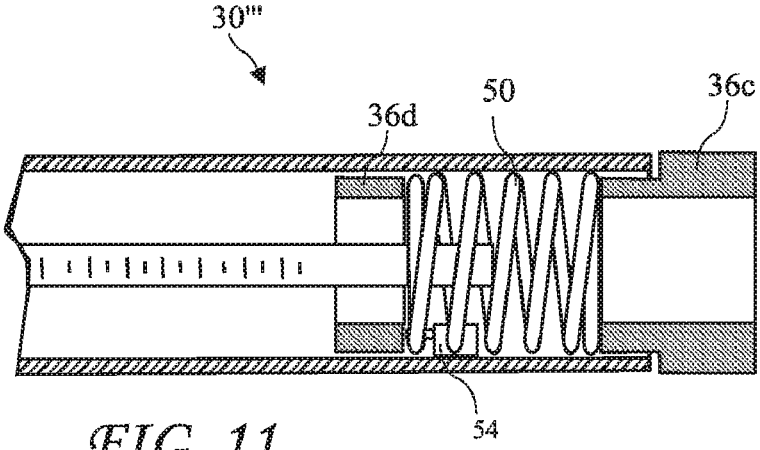
FIG. 11 is a partial cross-sectional view of the second actuator body according with a spring included in an actuator body bushing according to the present invention taken along line 5-5 of FIG. 4 of the linear actuator.
Figure 10:
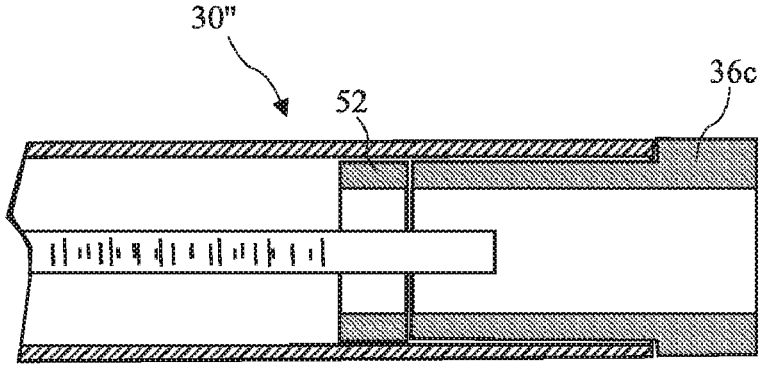
FIG. 10 is a partial cross-sectional view of the second actuator body according with a rubber bumper included in an actuator body bushing according to the present invention taken along line 5-5 of FIG. 4 of the linear actuator.

A partial cross-sectional view of the second actuator body 30' with a two part actuator body bushing 36*c* including a rubber bumper 52 for contact with the actuator piston bushing 42 according to the present invention taken along line 5-5 of FIG. 4 is shown in FIG. 11. The rubber bumper 52 is selected to compress to provide a preferred force on the engagement of threads on an actuator screw 34 with the actuator piston nut 44.

A partial cross-sectional view of the second actuator body 30' with a two part actuator body bushing 36*c* and a spring 50 separating the two parts according to the present invention taken along line 5-5 of FIG. 4 is shown in FIG. 11. The spring 50 is selected to provide a preferred force on the engagement of threads on an actuator screw 34 with the actuator piston nut 44. Additionally, a switch 54 may be provided in the linear actuator 20 to cut power to the actuator motor 32 when the linear actuator 20 reaches full extension.

Figure 12:
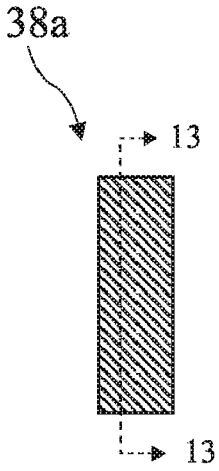
FIG. 12 is a screw cap of the linear actuator according to the present invention.
Figure 13:
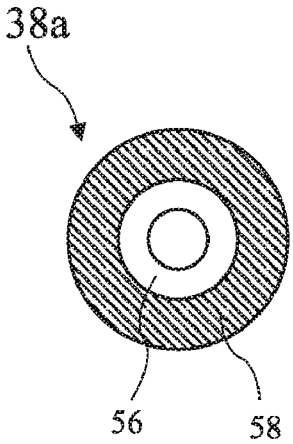
FIG. 13 is a cross-sectional view taken along line 13-13 of FIG. 12 of the screw cap showing a screw cap bearing according to the present invention.

A second screw cap 38*a* of the linear actuator 20 according to the present invention is shown in FIG. 12 and a cross-sectional view of the screw cap 38*a* taken along line 13-13 of FIG. 12 showing a screw cap bearing 56 according to the present invention is shown in FIG. 13. The use of a cap screw 38*a* with a bearing 56 reduces or prevents wear of the cap screw 38*a* and thereby provides consistent lowering of the tower loop 18.

The actuator body 30 and the actuator piston 40 are preferably made from aluminum and preferably anodized. The bushings are preferably made from Delrin® plastic material.

While the invention herein disclosed has been described by means of specific embodiments and applications thereof, numerous modifications and variations could be made thereto by those skilled in the art without departing from the scope of the invention set forth in the claims.

I claim:

1. A water craft with an automatic lowering tow tower, the water craft and tower comprising:

a water craft having a bow, a mid-section, and a stern;

a tower support structure firmly attached to the water craft and residing near the mid-section of the water craft;

a pair of laterally spaced apart tower pivots attached to the tower support structure;

a tower loop pivotally attached to the tower support structure by the tower pivots and forming a "U" shaped loop, an open end of the "U" to the bow of the water craft; and two lockable linear actuators pivotally attached between the tower support structure and the tower loop, the linear actuators having a retracted position, wherein the tower loop is lowered and an extended position wherein the tower loop is raised, and wherein the linear actuators jam-lock in the fully extended position until the linear actuators are reversed, the linear actuators comprising:

an actuator body;

an actuator motor residing inside the actuator body;

an actuator piston residing partly in the body and longitudinally slidable in the body and having an inside end and an extending end;

an actuator piston nut fixed to the inside end of the actuator piston and having internal threads;

a rotatable actuator screw residing inside the body and having a driven end connected to the actuator motor and external threads engaging the internal threads in the actuator piston nut, and having an actuator piston end opposite the driven end; and a screw cap on an end of the actuator screw opposite the actuator motor, wherein, the linear actuator includes a jam-lock feature selected from the set consisting of:

the screw cap includes a compressible material facing the actuator piston nut and the compressible material is jammed against the actuator piston nut to jam-lock the linear actuator in the fully extended position; and the actuator piston nut include the compressible material facing the screw cap and the compressible material is jammed against the screw cap to jam-lock the linear actuator in the fully extended position.

2. The water craft and tower of claim 1, wherein the am-lock feature comprises the compressible material on the actuator piston nut.

3. The water craft and tower of claim 1, wherein the jam-lock feature comprises the compressible material on the screw cap.

4. The water craft and tower of claim 3, wherein the screw cap comprises the compressible material over a metal.

5. The water craft and tower of claim 3, wherein the screw cap is made from a compressible plastic material to provide a screw cap including a compressible material.

6. The water craft and tower of claim 3, wherein the screw end cap includes a bearing to allow free rotation of the screw end cap to reduce wear.

7. A water craft with an automatic lowering tow tower, the water craft and tower comprising:

a water craft having a bow, a mid-section, and a stern;

a tower support structure firmly attached to the water craft and residing near the mid-section of the water craft;

a pair of laterally spaced apart tower pivots attached to the tower support structure;

a tower loop pivotally attached to the tower support structure by the tower pivots and forming a "U" shaped loop, an open end of the "U" to the bow of the water craft; and two lockable linear actuators each comprising:

an actuator body;

an actuator motor residing inside the actuator body;

an actuator piston residing partly in the body and longitudinally slidable in the body and having an inside end and an extending end;

an actuator piston nut fixed to the inside end of the actuator piston and having internal threads;

an actuator piston bushing attached to the actuator piston and sliding against an inside surface of the actuator body;

a rotatable actuator screw residing inside the body and having a driven end connected to the actuator motor and external threads engaging the internal threads in the actuator piston nut, and having an actuator piston end opposite the driven end; and an extended actuator body bushing opposite the actuator motor, wherein at least one of the extended actuator body bushing and the actuator piston bushing is compressible and at full extension, the extended actuator body bushing contacts the actuator piston bushing to compress the compressible one of the extended actuator body bushing and the actuator piston bushing to jam-lock the linear actuator in the fully extended position, the linear actuators pivotally attached between the tower support structure and the tower loop, the linear actuators having a retracted position, wherein the tower loop is lowered and an extended position wherein the tower loop is raised, and wherein the linear actuators jam-lock in the fully extended position until the linear actuators are reversed.

8. The water craft and tower of claim 7, wherein the extended actuator body bushing is a two part bushing with a spring between the parts thereby providing a compressible extended actuator body bushing.

9. The water craft and tower of claim 8, further including a switch for cutting off power to the actuator motor at full actuator extension.

10. The water craft and tower of claim 7, wherein the extended actuator body bushing includes a rubber bumper facing the actuator piston bushing thereby providing a compressible extended actuator body bushing.

11. A water craft with an automatic lowering tow tower, the water craft and tower comprising:

a water craft having a bow, a mid-section, and a stern;

a tower support structure firmly attached to the water craft and residing near the mid-section of the water craft;

a pair of laterally spaced apart tower pivots attached to the tower support structure;

a tower loop pivotally attached to the tower support structure by the tower pivots and forming a "U" shaped loop, an open end of the "U" to the bow of the water craft; and two lockable linear actuators pivotally attached between the tower support structure and the tower loop, the linear actuators having a retracted position, wherein the tower loop is lowered and an extended position wherein the tower loop is raised, and wherein the linear actuators jam-lock in the fully extended position until the linear actuators are reversed, the linear actuators comprising:

an actuator body;

an actuator motor residing inside the actuator body;

an actuator piston residing partly in the body and longitudinally slidable in the body and having an inside end and an extending end;

an actuator piston nut fixed to the inside end of the actuator piston and having internal threads;

a rotatable actuator screw residing inside the body and having a driven end connected to the actuator motor and external threads engaging the internal threads in the actuator piston nut, and having an actuator piston end opposite the driven end; and a compressible member of the linear actuator, the compressible member coming into contact with a cooperating member of the linear actuator when the linear actuator is in the fully extended position and thereby compressing to create a compressive counterforce to provide sufficient residual force on engagement of the actuator screw threads with the actuator piston nut threads to prevent the actuator screw from gradually turning and lowering the tower loop.

* * * * *